US005784958A

United States Patent [19]

Dylla et al.

[11] Patent Number: 5,784,958

[45] Date of Patent: Jul. 28, 1998

[54] ROTARY PRINTING MACHINE WITH AN UNDERSTRUCTURE

[75] Inventors: Norbert Dylla, Stadtbergen; Johann Schlittenbauer, Aichach; Johann Öschay, Wehringen, all of Germany

[73] Assignee: MAN Roland Druckmaschinen AG, Offenbach am Main, Germany

[21] Appl. No.: 813,042

[22] Filed: Mar. 7, 1997

[30] Foreign Application Priority Data

Mar. 7, 1996 [DE] Germany ..... 196 50 812.6

[51] Int. Cl.[6] ..... B41F 5/00

[52] U.S. Cl. ..... 101/216; 101/212; 101/479; 101/480

[58] Field of Search ..... 101/212, 216, 101/130, 141, 136, 150, 153, 171, 174, 214, 479, 480

[56] References Cited

U.S. PATENT DOCUMENTS

| | | | |
|---|---|---|---|
| 3,390,633 | 7/1968 | Boughton | 101/216 |
| 5,481,973 | 1/1996 | Schmid | 101/216 |
| 5,485,782 | 1/1996 | Van Der Horst | 101/216 |

FOREIGN PATENT DOCUMENTS

| | | |
|---|---|---|
| 26 52 141 | 8/1977 | Germany . |
| 29 24 591 | 1/1981 | Germany . |
| 93 16 412 | 3/1994 | Germany . |
| 93 18 226 | 3/1994 | Germany . |
| 43 17 684 | 12/1994 | Germany . |

*Primary Examiner*—Christopher A. Bennett
*Attorney, Agent, or Firm*—Cohen, Pontani, Lieberman & Pavane

[57] ABSTRACT

A rotary printing machine with an understructure that can be simply assembled from girders and then simply disassembled. The girders are connected to one another by removable attachment elements. For example, metal plates are used to connect the girders to one another. The understructure can be disassembled at one location and then reassembled at a different location.

20 Claims, 3 Drawing Sheets

ROTARY PRINTING MACHINE WITH AN UNDERSTRUCTURE

BACKGROUND OF THE INVENTION

1. Field of the Invention

The present invention relates to a rotary printing machine with an understructure that has a vertical girder.

2. Description of the Prior Art

An understructure for a rotary printing machine is known from DE 29 24 591 A1. According to an example shown in FIG. 4 of this reference, the understructure has several individual precast cement parts, namely side walls and a supporting plate. The precast cement parts have prefabricated metal frames in their respective interiors, around which cement is poured. The supporting plate and the side walls have cement fastening projections formed on their bottom sides. The fastening projections match, in shape and position, corresponding fastening depressions in the parts being connected, so that the projections can be inserted into the depressions. This means that the side walls have depressions on their top sides, into which projections located on the bottom side of the supporting plate can be inserted. The gaps that remain between the fastening projections and the fastening depressions after the side walls and the supporting plate have been put together must be potted with a filler, such as special cement.

In the known method of assembling an understructure for a printing machine, it is disadvantageous that the supporting plate and the side walls are connected to each other rigidly and in a non-detachable fashion. Because of this manner of construction, the understructure cannot be disassembled without being damaged. Each girder must have a frame of precisely manufactured and structured steel parts. The supporting and connecting struts that hold the steel plates resting on the girders from the outside must be rigidly connected to the frame.

Another disadvantage of the known understructure is that the supporting plate and the side walls cannot be connected to one another with any great precision. The fastening projections must necessarily have relatively large clearances inside the fastening depressions. The supporting plates thus must be readjusted to the side walls, which involves a complicated procedure.

SUMMARY OF THE INVENTION

Accordingly, it is an object of the invention to provide a rotary printing machine with an understructure that can be simply assembled and disassembled.

Pursuant to this object, and others which will become apparent hereafter, one aspect of the present invention resides in a rotary printing machine comprised of an understructure having vertical girders with upper end faces, metal plates provided on the upper end faces of the vertical girders for establishing detachable connections, a support element releasably connected to the metal plates so as to rest horizontally on the end faces of the vertical girders, and means, provided on the bottom sides of the support elements and corresponding to the metal plates of the vertical girders, for releasably connecting the support elements to the vertical girders.

In another embodiment of the invention the support element is a horizontal first girder, and preferably a cross-girder.

In still another embodiment of the invention the lower end region of the vertical girders is formed as a truncated pyramid which accommodated in holders of a foundation or a bottom plate. The truncated pyramids can be coated, in another embodiment of the invention, with a separating agent so that the vertical girders can be lifted out again from the holders after insertion.

In a further embodiment of the invention, bearing plates are mounted to the lower end of the vertical girders for releasably attaching the vertical girders to a foundation or a bottom plate.

In yet another embodiment of the invention, second girders are provided so as to rest on the first girders, which second girders are transverse to the first girders.

An additional embodiment of the invention, provides the front ends of the second girders to have projections which rests on the top side of the first girders.

In another embodiment of the invention rails or other attachment elements, such as screw holes, threads or threaded borings, stay bolts, bearing or bolts or attachments bolts are arranged on the girders. An additional embodiment of the invention provides holding means arranged on the girders for securing components of the printing machine or aggregates and auxiliary devices belonging to the printing machine.

Additionally, metal plates or bearing shields can be provided for attaching bearing blocks that support a roll changer or its drive, for attaching a functional unit that consists of roller driving belts, their bearing elements and their drive, or attaching a gluing device. It still further being possible to provide metal plates or bearing shields arranged on the girders for attaching drive motors for printing mechanisms for individual cylinders within the printing mechanisms.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
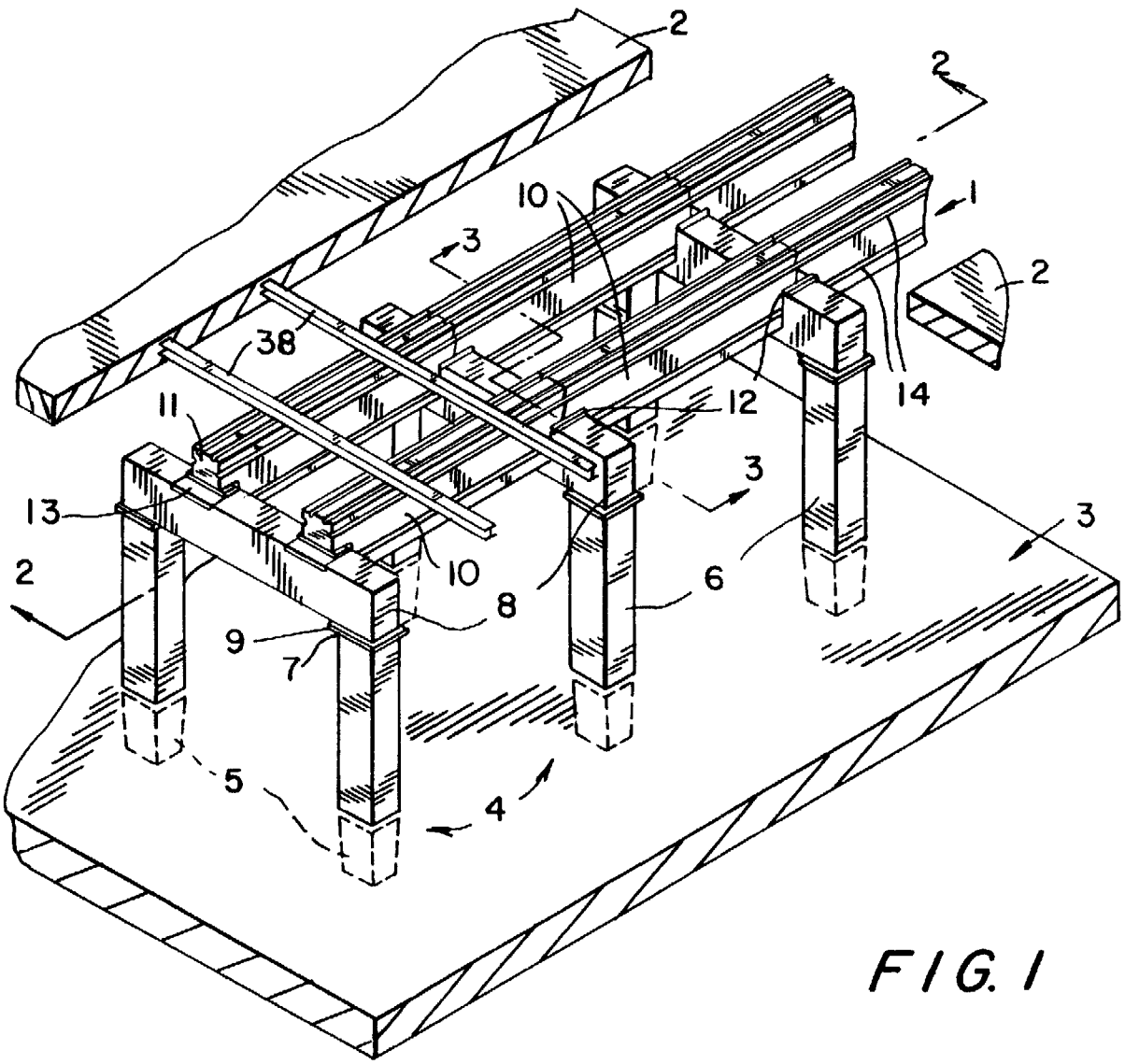
FIG. 1 is a perspective view of the understructure for a rotary printing machine, pursuant to the present invention.

An understructure (FIG. 1) for a rotary printing machine 20 (FIGS. 2, 3) is mounted below a covering 2 on a foundation 3 or a cement bottom plate, for example. The foundation 3 has holders 4 to accommodate the lower ends 5, designed as truncated pyramids, of vertical girders 6. The girders 6 have a steel mesh or individual steel rods (which can be connected among themselves) in their interiors. Neither the steel frame nor the steel rods require precise fabrication or precise positioning. Either the inner walls of the holders 4 are matched precisely to the shape of the truncated pyramids 5, or else the holders 4 extend laterally outward over the truncated pyramids 5. In this case, the gap remaining between the truncated pyramids 5 and the inner walls of the holders 4 is potted with a filler, e.g., cement. Before this is done, the bottom side and the side walls of the truncated pyramids 5 are coated with a separating agent, so that the girders 6 can be lifted off the bottom plate or the foundation 3 again by means of hoisting equipment.

The vertical girders 6 have metal plates 7 on their upper faces to hold horizontal girders 8. The horizontal girders 8 have attachment means at the ends of their bottom sides, for attaching the horizontal girders 8 to the metal plates 7. Preferably, the horizontal girders 8 are provided with metal plates 9, at the ends of their bottom sides, which additional metal plates 9 rest on the metal plates 7. The metal plates 7, 9 have openings therein located vertically one above the other, for example, so that they can be connected to each other by screws and nuts. The metal plates 7, 9 are connected securely to the girders 6, 8 by elements that extend into the interior of the girders 6, 8, e.g., clasps or hooks potted in cement.

Figure 2:
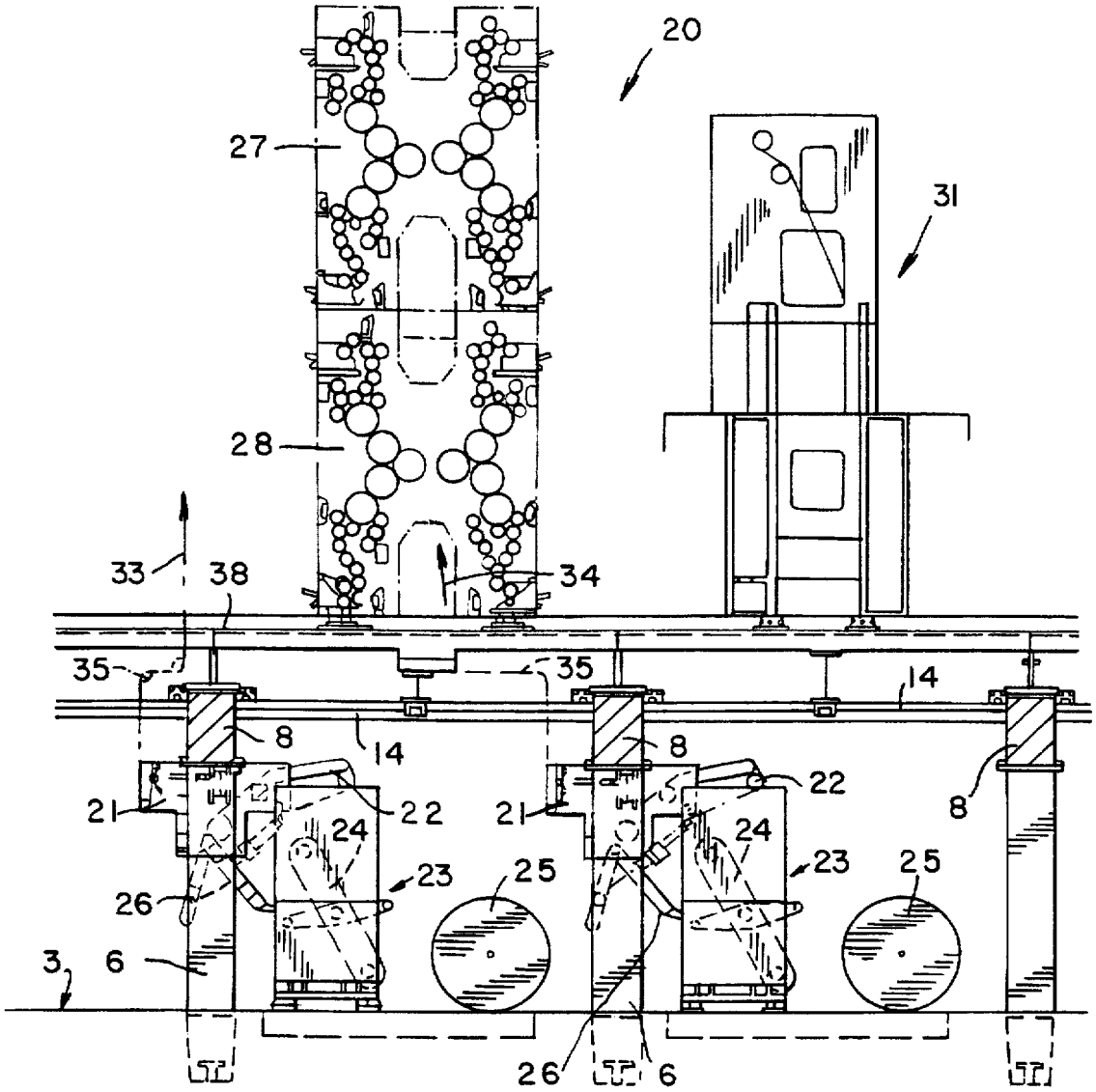
FIG. 2 is a longitudinal section along Line 2—2 in FIG. 1 of the understructure, together with a rotary printing machine mounted on it.
Figure 3:
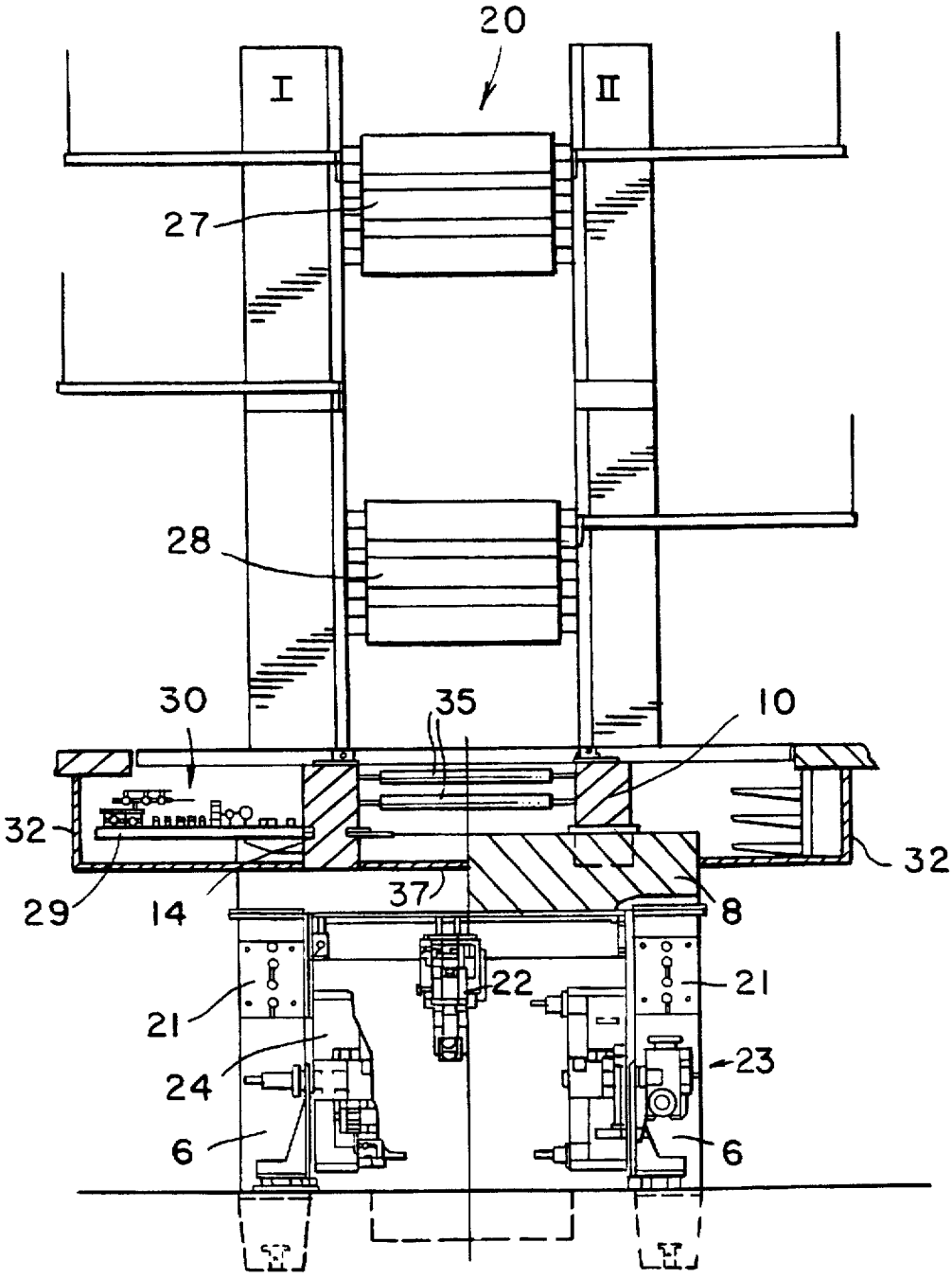
FIG. 3 is a sectional view of the understructure and the rotary printing machine, showing a cross-girder belonging to the understructure as well as longitudinal understructure girders, along Line 3—3 in FIG. 1.

Resting on the horizontal girders 8, which serve as cross-girders according to FIGS. 1 to 3, are additional horizontal girders 10. The horizontal girders 10 serve as longitudinal girders FIGS. 1 to 3. The girders 10 have a projection 11 on their front faces, for example, which allows the girders 10 to rest on the girders 8 with a part that extends out in the longitudinal direction. The girders 10 also have attachment means, for example, metal plates 12, on the bottom side of the projections 11. The attachment means are secured to corresponding attachment means, for example, metal plates, 13, on the top side of the girders 8.

The metal plates 12, 13 are connected to one another in detachable fashion. The girders 10 rest on the girders 8 so that the fronts of the projections 11 abut one another in the middle of the top side of the girders 8. Instead of the girders 8 and 10, there can be girder plates, which are secured to the upper faces of the girders 6 in the manner described above. The girders 10 or the supporting plates carry printing units 27, 28 of a rotary printing machine 20, which can have a plurality of adjacent printing units as well as a folding unit 31. The printing units 27, 28 and the folding unit 31 are secured horizontally on a plane and aligned on the girders 10 by levelling elements 36. Instead of arranging the cross-girders 8 on the vertical girders 6, it is possible to arrange the longitudinal girders 10 directly on the vertical girders 6. In this case, the longitudinal girders 10 carry the cross-girders 8.

On the girders 6, 8 and 10, holding means are provided for securing components of the rotary printing machine 20 or aggregates and auxiliary devices belonging to the rotary printing machine 20. For example, the girders 10 have rails 14 on their top and lateral longitudinal sides. It is also possible to arrange rails on the longitudinal sides of the girders 6 and 8. Other connecting and attaching elements, such as screw holes, threads and threaded borings, stay bolts, bearing bolts and attachment bolts, can also be attached to the girders 6, 8 and 10. It is possible, by means of the rails 14 on the girders 6, 8 and 10, or attachment means cast in cement, to rest external metal plates on the longitudinal sides of the girders 6 or the front sides of the girders 8, in order to attach functional units of the printing machine.

Metal plates or bearing blocks 21 (FIGS. 2, 3) attached to the girders 6 serve, for example, to attach belt drives 22, which belong to roll changers 23. The roll changers 23 have carrying arms 24 for holding rolls of paper 25. The bearing blocks 21 also carry gluing devices 26 belonging to the roll changers 23. The metal plates or bearing blocks 21 can also be used to attach drive motors for individual printing mechanisms in the printing units 27, 28 of the rotary printing machine 20 or for individual cylinders in the printing units 27, 28. Paper webs 33, 34 are unwound from paper rolls (not shown here) held by the carrying arms 24 and driven by the belt drive 22. The paper webs 33, 34 are drawn into the printing units 27, 28 by deflection rollers 35. The deflection rollers 35 are mounted between the girders 10 of the understructure.

It is possible, by means of rails 14 on the outer longitudinal sides of the girders 10, to attach metal plates 29 (FIG. 3), over which run supply lines 30 for gear oil, pressurized air and printers ink for the rotary printing machine 20.

Attached to the horizontal girders 8 and 10 are housings 32, which are connected to the cover 2 and provide acoustic insulation. In the area between the girders 10, there are acoustic protection plates 37, which have openings for the paper webs 33, 34 to pass through. Resting on the girders 10 are double-T girders 38, which hold footboards for the operating personnel of the rotary printing machine 20.

It is also possible to attach transport rails for paper rolls to metal plates and bearing shields in the lower area of the girders 6, so that paper rolls can be moved between the girders 6 in the longitudinal direction of the understructure 1. Thus, different holding means can be located on the girders 6, 8 and 10.

The girders 6 can be attached to the foundation 3 or a bottom plate by means of bearing plates, rather than holders 4, when the foundation 3 or the bottom plate has suitable attachment means, such as metal plates or anchoring screws.

The invention provides an understructure 1 made up of girders 6, 8 and 10 that can be simply assembled and disassembled. The girders are connected to one another by detachable attachment elements. For example, metal plates 7, 9, 12 and 13 are used to connect the girders 6 and 8 or 8 and 10 to one another. Thus, the understructure 1 can be disassembled and then assembled again at a different location.

The invention is not limited by the embodiments described above which are presented as examples only but can be modified in various ways within the scope of protection defined by the appended patent claims.

We claim:

1. A rotary printing machine, comprising an understructure having vertical girders with upper end faces, metal plates provided on the upper end faces of the vertical girders, support elements having bottom sides, the support elements being releasably connected to the metal plates so as to rest horizontally on the upper end faces of the vertical girders, and means, located on the bottom sides of the support elements so as to correspond to the metal plates of the vertical girders, for releasably connecting the support elements to the vertical girders.

2. A rotary printing machine as defined in claim 1, wherein the means provided on the bottom sides of the support elements include metal plates.

3. A rotary printing machine as defined in claim 2, and further comprising screw means for releasably connecting the metal plates of the support elements with the metal plates of the vertical girders.

4. A rotary printing machine as defined in claim 1, wherein the supporting elements are horizontal first girders.

5. A rotary printing machine as defined in claim 4, wherein the horizontal first girders are cross-girders.

6. A rotary printing machine as defined in claim 1, wherein the vertical girders have a lower end region formed as a truncated pyramid, the printing machine further comprising a base member and holders provided at the base member for holding the truncated pyramids.

7. A rotary printing machine as defined in claim 6, wherein the base member is a foundation.

8. A rotary printing machine as defining in claim 6, wherein the base member is a bottom plate.

9. A rotary printing machine as defined in claim 6, wherein the truncated pyramids are coated with a separating agent so that the vertical girders can be lifted out from the holders.

10. A rotary printing machine as defined in claim 1, and further comprising bearing plates mounted to a lower end of the vertical girders for releasably attaching the vertical girders to one of a foundation and a bottom plate.

11. A rotary printing machine as defined in claim 4, and further comprising second girders that rest on the first horizontal girders and are transverse thereto.

12. A rotary printing machine as defined in claim 11, wherein the second girders have ends at which projections are formed that rest on a top side of the first girders.

13. A rotary printing machine as defined in claim 11, and further comprising additional metal plates correspondingly anchored to the first and second girders, and detachable connecting means for connecting together the additional metal plates of the first and second girders.

14. A rotary printing machine as defined in claim 11, and further comprising means provided on at least one of the vertical girders, the first horizontal girders and the second girders for attaching auxiliary equipment.

15. A rotary printing machine as defined in claim 14, wherein the means for attaching auxiliary equipment includes rails attached to the at least one of the vertical girders, the first horizontal girders, and the second girders.

16. A rotary printing machine as defined in claim 14, wherein the means for attaching auxiliary equipment includes at least one of screw holes, threads, threaded bores, stay bolts, bearing bolts and attachment bolts.

17. A rotary printing machine as defined in claim 11, and further comprising holding means, arranged on at least one of the vertical girders the first horizontal girders, and the second girders, for securing at least one of components of the printing machine, and aggregates and auxiliary devices of the printing machine.

18. A rotary printing machine as defined in claim 1, and further comprising a roll changer having a drive, a functional unit consisting of roller driving belts, bearing elements and a drive, a gluing device, drive motors for printing mechanisms, and individual cylinders of printing mechanisms, and still further comprising bearing members arranged on the girders so as to support at least one of the roll changer and its drive, the functional unit, the gluing device, the printing mechanism drive motors and the individual cylinders.

19. An understructure for a rotary printing machine, comprising: vertical girders having upper end faces; metal plates provided on the upper end faces of the vertical girders; support elements having bottom sides, the support elements being releasably connected to the metal plates so as to rest horizontally on the upper end faces of the vertical girders; and, means, located on the bottom sides of the support elements so as to correspond to the metal plates of the vertical girders, for releasably connecting the support elements to the vertical girders.

20. A combination of an understructure and a rotary printing machine, the understructure including vertical girders having upper end faces, metal plates provided on the upper end faces of the vertical girders, support elements having bottom sides, the support elements being releasably connected to the metal plates so as to rest horizontally on the upper end faces of the vertical girders, and, means, located on the bottom sides of the support elements so as to correspond to the metal plates of the vertical girders, for releasably connecting the support elements to the vertical girders, the rotary printing machine being mounted to the understructure.

* * * * *